US005796371A

United States Patent [19]

Sato et al.

[11] Patent Number: 5,796,371

[45] Date of Patent: Aug. 18, 1998

[54] OUTDOOR CONVERTER FOR RECEIVING SATELLITE BROADCAST

[75] Inventors: Makoto Sato; Shigetaka Suzuki, both of Fukushima-ken; Shuji Saito, Iwate-ken; Makoto Shigihara, Fukushima-ken, all of Japan

[73] Assignee: Alps Electric Co., Ltd., Tokyo, Japan

[21] Appl. No.: 679,639

[22] Filed: Jul. 10, 1996

[30] Foreign Application Priority Data

Jul. 19, 1995 [JP] Japan ..... 7-182876
Jul. 19, 1995 [JP] Japan ..... 7-182880

[51] Int. Cl.[6] ..... H01Q 13/00

[52] U.S. Cl. ..... 343/786; 343/772; 333/21 A; 333/21 R

[58] Field of Search ..... 343/772, 786, 343/783, 784; 333/21 A, 21 R, 26

[56] References Cited

U.S. PATENT DOCUMENTS

| | | | |
|---|---|---|---|
| 4,412,222 | 10/1983 | Möring | 343/779 |
| 4,554,553 | 11/1985 | Grim | 343/786 |
| 4,707,702 | 11/1987 | Withers | 343/786 |
| 4,996,535 | 2/1991 | Profera, Jr. | 343/786 |
| 5,001,444 | 3/1991 | Salvan et al. | 33/21 A |
| 5,043,683 | 8/1991 | Howard | 333/21 A |
| 5,218,373 | 6/1993 | Heckaman et al. | 343/786 |
| 5,331,332 | 7/1994 | West et al. | 343/786 |
| 5,374,938 | 12/1994 | Hatazawa et al. | 343/756 |
| 5,459,441 | 10/1995 | Weber et al. | 343/786 |

FOREIGN PATENT DOCUMENTS

| | | |
|---|---|---|
| 0350324A2 | 10/1990 | European Pat. Off. . |
| 5-267903 | 10/1993 | Japan . |

*Primary Examiner*—Donald T. Hajec
*Assistant Examiner*—Tan Ho
*Attorney, Agent, or Firm*—Guy W. Shoup

[57] ABSTRACT

An outdoor satellite broadcast receiving converter including a waveguide into which a broadcast electric wave enters and in which the broadcast electric wave travels in an axial direction as a first linearly polarized wave and a second linearly polarized wave. A first probe is disposed at a predetermined position and extends perpendicular to the axial direction into the waveguide for detecting the first linearly polarized wave. A substrate is disposed in the waveguide approximately ¼ wavelength from the first probe and arranged to extend across an open end of the waveguide. A first shorting terminal for reflecting the first linearly polarized wave is formed on a first side of the substrate, and a second probe for detecting the second linearly polarized wave is formed on an opposing second side of the substrate. A metallic case is connected over the open end of the waveguide such that the substrate is positioned between a closed bottom of the metallic case and the first probe. The closed bottom of the metallic case is disposed about ¼ wavelength from the substrate, and includes a second shorting terminal for reflecting the second linearly polarized wave.

34 Claims, 7 Drawing Sheets

OUTDOOR CONVERTER FOR RECEIVING SATELLITE BROADCAST

BACKGROUND OF THE INVENTION

1. Field of the Invention

The present invention relates to an outdoor satellite broadcast receiving converter having a coaxial waveguide converter unit for receiving two kinds of linearly polarized waves independent of each other and which is provided in an outdoor antenna system.

2. Description of the Related Art

FIGS. 9 to 11 are diagrams for explaining a conventional outdoor converter of this kind; FIG. 9 is an external appearance view; FIG. 10 is a sectional side view; and FIG. 11 is a front view.

As shown in these figures, the conventional converter has a first probe 2, a shorting rod 3 and a second probe 4 successively disposed along the direction of travel of electric waves transmitted from a satellite (the direction of arrow A) at predetermined positions in a waveguide 1 in the form of a cylinder closed at one end. The first probe 2 serves to detect a first linearly polarized wave (e.g., a horizontally polarized wave). The shorting rod 3 reflects this first linearly polarized wave to enable this wave to be detected with the first probe 2. The second probe 4 serves to detect a second linearly polarized wave (e.g., a vertically polarized wave) orthogonal to the first linearly polarized wave. An inner bottom surface of the waveguide is formed as a shorting surface 1*b* for reflecting the second linearly polarized wave to enable this wave to be detected with the second probe 4. To limit the conversion loss, each of the distance between the first probe 2 and the shorting rod 3 and the distance between the second probe 4 and the shorting surface 1*b* is set to about ¼ of the wavelength of electric waves to be received. Also, the distance between the first probe 2 and the second probe 4 is set to about ¾ of the wavelength of received electric waves to prevent polarized wave signals detected with the probes 2 and 4 from interfering with each other so that isolation therebetween deteriorates. Each of the shorting rod 3 and the shorting surface 1*b* is connected to a grounding electrode (not shown).

On the other hand, outside the waveguide 1 are disposed a first circuit substrate 5 on which the first probe 2 is supported while being connected to a wiring pattern (microstrip line) and a second circuit substrate 6 on which the second probe 4 is supported while being connected to a wiring pattern (microstrip line). An output connector 8 for outputting received signals projects outward through a bottom portion of a casing 7 which covers the above-described parts. Processing circuits for suitably processing signals detected with the first and second probes 2 and 4 (by amplification, frequency conversion, etc.) are provided on the first and second circuit substrates 5 and 6.

The above-described conventional outdoor satellite broadcast receiving converter is designed to achieve improved isolation by forming such a structure that the first and second probes 2 and 4, projecting in the waveguide orthogonally to each other, are spaced apart from each other about ¾ of the wavelength in the electric wave travel direction. In this structure, however, it is difficult to reduce the overall size of the apparatus because a distance approximately equal to the wavelength of received electric waves must be maintained between the first probe 2 and the shorting surface 1*b* for the second probe 4. Moreover, in this conventional structure, the first probe 2, the shorting rod 3 and the second probe 4, which are parts provided independently of each other, are combined with the waveguide 1, and the probes 2 and 4 are respectively connected to the separate circuit substrates 5 and 6. Thus, a large number of component parts has been required. This has been a prime cause of an increase in the manufacturing cost.

SUMMARY OF THE INVENTION

In view of the above-described problem of the conventional art, an object of the present invention is to provide an outdoor satellite broadcast receiving converter advantageous in terms of reduction in size and manufacturing cost.

To achieve this object, according to one aspect of the present invention, there is provided an outdoor satellite broadcast receiving converter comprising a waveguide into which a broadcast electric wave enters and in which the broadcast electric wave travels as a first linearly polarized wave and a second linearly polarized wave orthogonal to each other, a first probe for detecting the first linearly polarized wave, the first probe being disposed at a predetermined position in the waveguide, a first shorting terminal for reflecting the first linearly polarized wave, the first shorting terminal being disposed about ¼ wavelength apart from the first probe in the electric wave travel direction, a second probe for detecting the second linearly polarized wave, the second probe being disposed in the waveguide into which the first shorting terminal, and a second shorting terminal for reflecting the second linearly polarized wave, the second shorting terminal being disposed about ¼ wavelength apart from the second probe in the electric wave travel direction.

According to another aspect of the invention, an attachment structure for attaching the first probe comprises a waveguide into which a broadcast electric wave enters and in which the broadcast electric wave travels as two kinds of linearly polarized waves orthogonal to each other, a circuit substrate disposed at an opening end of the waveguide perpendicularly to an axial direction of the waveguide, and a probe for detecting one of the two kinds of linearly polarized waves traveling in the waveguide, the probe having a base end portion connected to the circuit substrate, the probe extending from its base end portion so as to be generally L-shaped. A groove is formed in an inner wall portion of the waveguide so as to extend in the axial direction of the waveguide and to be open at the opening end. A portion of the probe which extends straight from the base end portion is set in an insulated state in the groove, and a portion of the probe on the extreme end side of the straight-extending portion projects in the waveguide.

For example, the arrangement may be such that the substrate is positioned about ¼ wavelength apart from the first probe in the electric wave travel direction, and the first shorting terminal is provided on one of the two surfaces of the substrate facing the first probe while the second probe is provided on the other surface of the substrate. Preferably, to form this substrate, a portion of a circuit substrate on which circuits for processing signals detected with the first and second probes are formed is extended in the waveguide.

If the first shorting terminal and the second probe are positioned about ¼ wavelength apart from the first probe in the electric wave travel direction as described above, the distance between the first probe and the second shorting terminal is about ½ of the wavelength of electric waves to be received, thereby achieving improved isolation.

In the above-described attachment structure, the extreme-end portion of the generally L-shaped first probe projecting in the waveguide and the circuit substrate to which the base end portion of the probe is connected can be set in parallel with each other. Therefore, the other probe can be connected to this circuit substrate. Thus, only one circuit substrate suffices for the two probes while two circuit substrates are required according to the conventional art. Also, since the circuit substrate is disposed at the opening end of the waveguide perpendicularly to the axial direction of the waveguide, it is not necessary for the apparatus to be increased in size according to a need for supporting the circuit substrate and the waveguide can be reduced in exterior configuration. If the first shorting terminal and the second probe are formed on obverse and reverse surfaces of the substrate, the number of component parts can be reduced. Further, if a part of a circuit substrate on which circuits for processing polarized wave signals are formed is used as this substrate, the number of component parts can be further reduced.

DESCRIPTION OF THE PREFERRED EMBODIMENT

Figure 1:
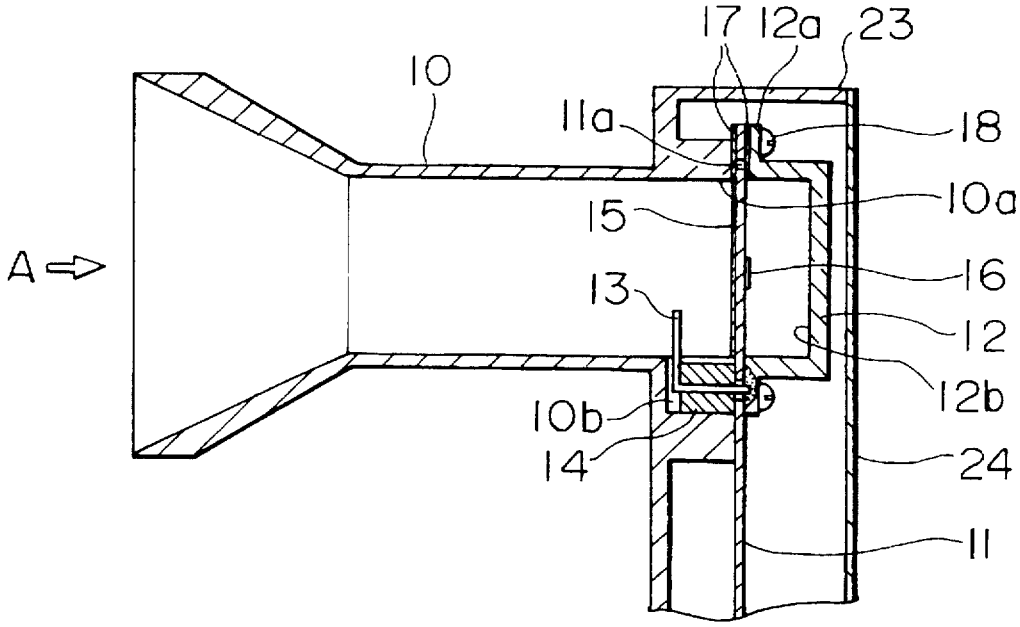
FIG. 1 is a sectional side view of an embodiment of the present invention.

An embodiment of an outdoor satellite broadcast receiving converter in accordance with the present invention will be described below with reference to the accompanying drawings.

The converter shown in FIGS. 1 to 8 has a waveguide 10 in the form of a tube opened at opposite ends. A circuit substrate 11 on which microstrip lines are formed extends at a rear opening end 10*a* of the waveguide 10. A metallic case 12 having a closed bottom and a flange 12*a* is disposed in such a position as to cover the opening end 10*a* with the circuit substrate 11 interposed therebetween. In the waveguide 10, a first probe 13 for detecting a first linearly polarized wave (e.g., horizontally polarized wave) in electric waves to be received is disposed on the front side of the circuit substrate at a distance of about ¼ of the wavelength of the received waves from the circuit substrate 11. The first probe 13 is generally L-shaped and has a base end portion connected to the circuit substrate 11. A portion of the first probe 13 extending straight from the base end portion is set in a recessed wall portion 10*b* of the waveguide 10 together with an insulating member 14 for covering this straight portion. The insulating member 14 is formed of Teflon or the like. In this state, an end portion of the first probe 13 opposite from the base end portion projects in the waveguide 10 by a predetermined distance. As shown, in FIGS. 7 and 8, a groove 26 is formed in an inner wall portion of the waveguide 10 at the rear end. The groove 26 extends along the axial direction of the waveguide 10 and is open at the opening end 10*a*. The portion of the generally L-shaped first probe 13 extending straight from the base end portion is set in the groove 26 in an insulated state. As clearly seen in FIG. 8, the groove 26 has a slit portion 26*a* small in width and open in an inner wall surface 10*b* of the waveguide 10 and a large-width portion 26*b* which is increased in width relative to the slit portion 26*a* and which communicates with the interior of the waveguide 10 through the slit portion 26*a*. The large-width portion 26*b* is circular in cross section and has an inside diameter approximately equal to the outside diameter of the insulating member 14.

A shorting pattern 15 for reflecting the first linearly-polarized wave to enable this wave to be detected with the first probe 13 is provided on one of the two surfaces of the circuit substrate 11 perpendicular to the axial direction of the waveguide 10, i.e., the surface facing the first probe 13. A second probe 16 for detecting a second linearly polarized wave (e.g., vertically polarized wave) orthogonal to the first linearly polarized wave is formed by patterning on the other surface of the circuit substrate 11. The thickness of the circuit substrate 11 is so small as to be negligible compared with the wavelength of received electric waves. Consequently, each of the shorting pattern 15 and the second probe 16 is positioned at a distance of about ¼ of the wavelength from the first probe 13 in the electric wave travel direction (in the direction of arrow A). In this embodiment, an inner bottom surface of the metallic case 12 is formed as a shorting surface 12*b* for reflecting the second linearly polarized wave to enable this wave to be detected with the second probe 16.

Figure 3:
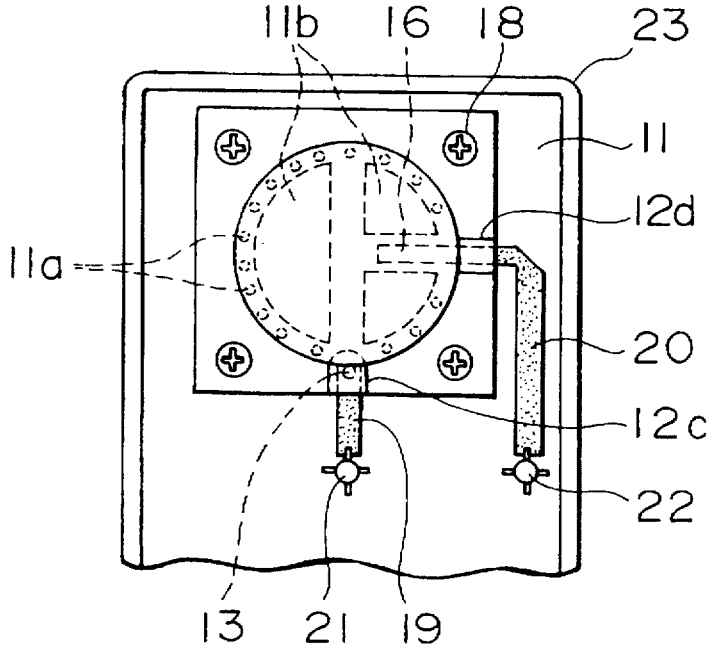
FIG. 3 is rear view showing the internal structure of the embodiment of the invention.
Figure 4:
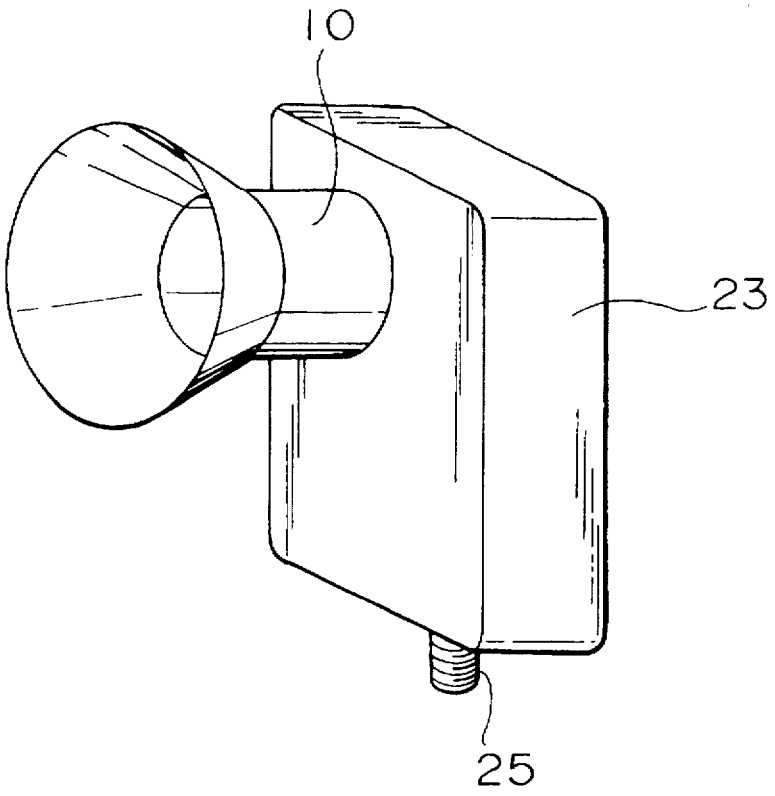
FIG. 4 is a perspective view of an external appearance of the embodiment of the invention.
Figure 5:
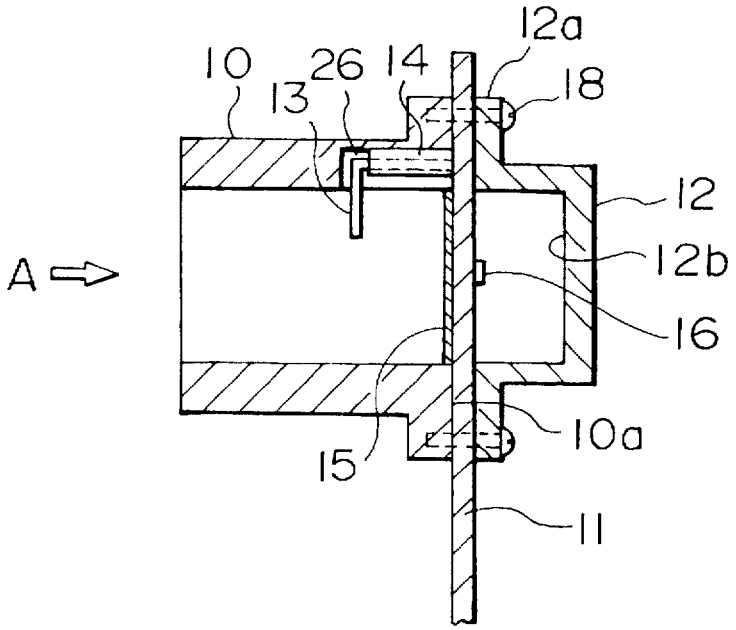
FIG. 5 is a sectional side view of the embodiment of the invention.
Figure 6:
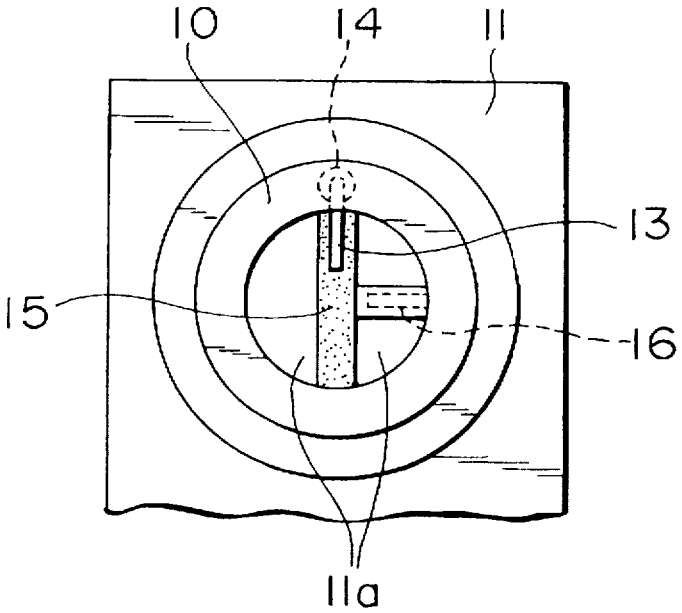
FIG. 6 is a front view of the embodiment of the invention.

On the circuit substrate 11 are provided processing circuits for suitably processing signals detected with the first probe 13 and the second probe 16 (by amplification, frequency conversion, etc.). As shown in FIG. 3, the first and second probes 13 and 16 are connected to initial-stage amplifier transistors 21 and 22 through lead-out patterns 19 and 20, respectively, on the circuit substrate 11. The metallic case 12 has clearance recesses 12*c* and 12*d* previously formed to avoid contact with the lead-out patterns 19 and 20.

Figure 2:
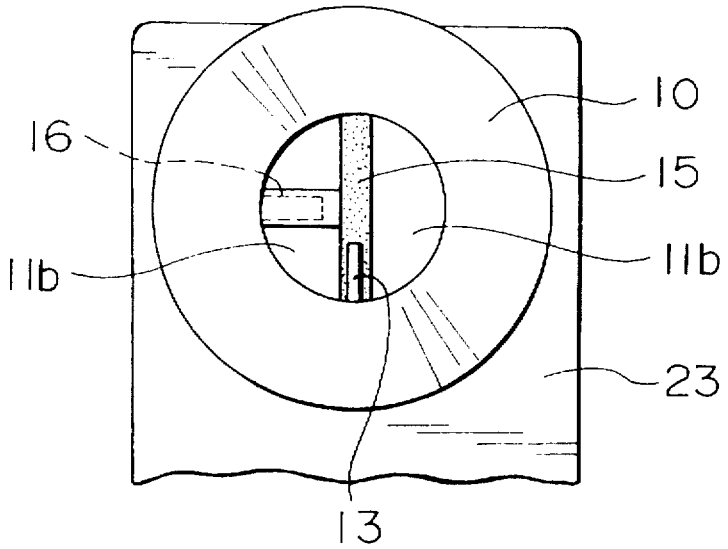
FIG. 2 is a front view of the embodiment of the invention.

The portion of the circuit substrate 11 placed in the waveguide 10 is worked so as to be generally T-shaped by forming cutouts 11*b* as shown in FIGS. 2 and 3. The shorting pattern 15 and the second probe 16 are formed on this generally T-shaped portion. That is, cutouts 11*b* are formed for the purpose of avoiding attenuation of the electric wave (the above-mentioned second linearly polarized wave) detected with the second probe 16.

Grounding electrodes 17 formed of solder plating layers are provided on the two surfaces of the circuit substrate 11 at positions corresponding to a peripheral portion of the rear opening end 10*a* of the waveguide 10. The grounding electrodes 17 are connected to each other via a plurality of through holes 11*a* formed in the circuit substrate 11 along the peripheral portion of the opening end 10*a* and are also connected to the shorting pattern 15. The flange 12*a* of the metallic case 12 is fixed to the peripheral portion of the opening end 10*a* of the waveguide 10 by screws 18 with the circuit substrate 11 interposed therebetween. Therefore, the waveguide 10 and the metallic case 12 are respectively pressed against the grounding electrodes 17 on the two surfaces of the circuit substrate 11 to be maintained in contact with the grounding electrodes 17. The circuit substrate 11 and the metallic case 12 attached to the rear portion of the waveguide 10 are placed in a chassis 23 provided as a circuit accommodation unit and are enclosed with a cover 24. An output connector 25 for outputting received signals projects out of the chassis 23.

Figure 7:
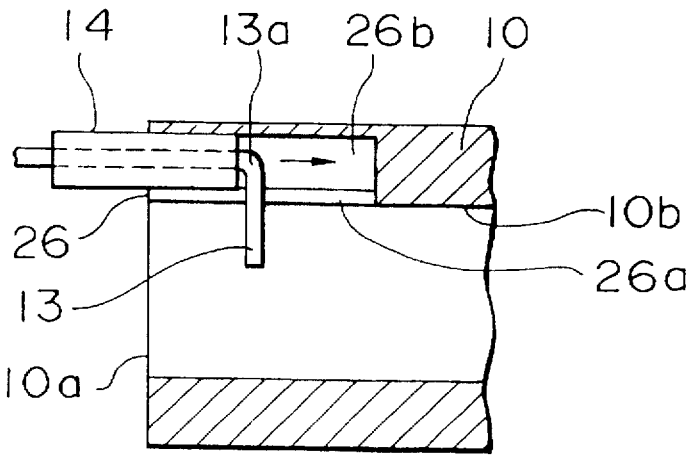
FIG. 7 is an illustration showing the process of fitting the first probe in the waveguide in the embodiment of the invention.
Figure 8:
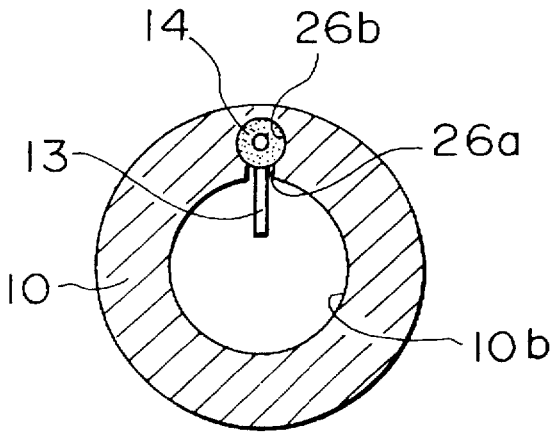
FIG. 8 is a diagram showing a state in which the first probe is fitted in the waveguide in the embodiment of the invention.
Figure 9:
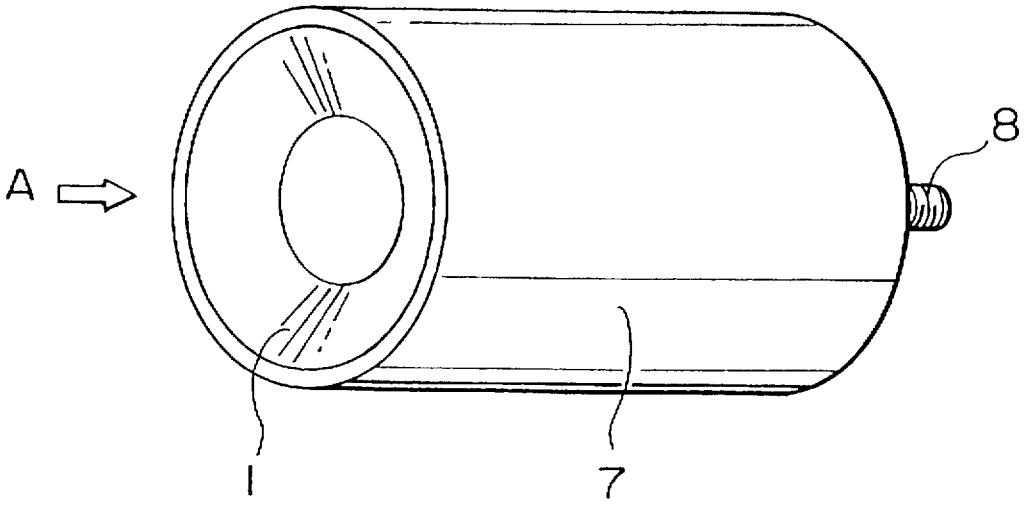
FIG. 9 PRIOR ART
FIG. 9 is a perspective view of an external appearance of a conventional converter.
Figure 10:
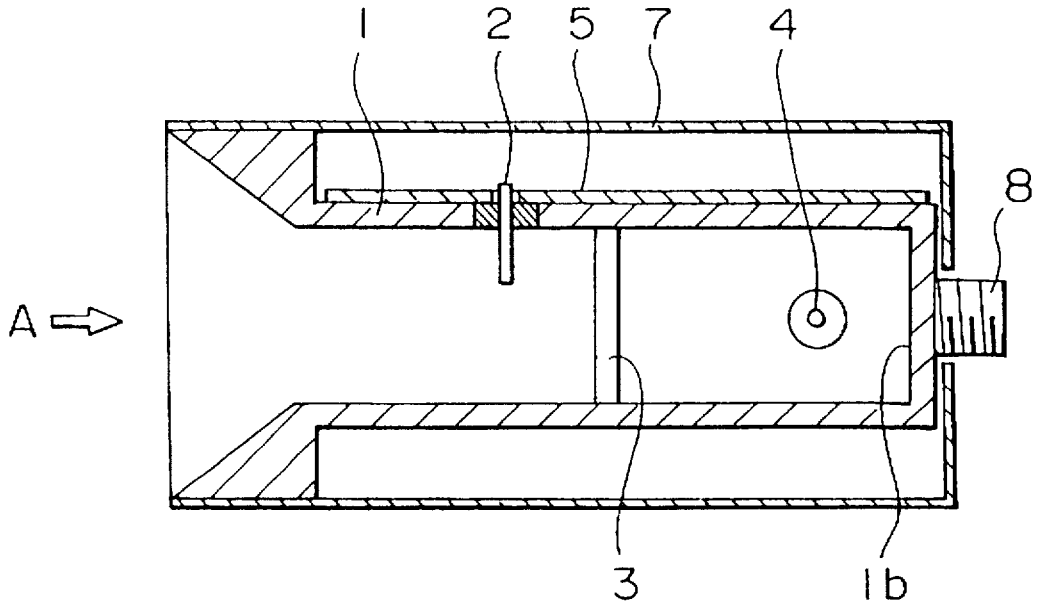
FIG. 10 PRIOR ART
FIG. 10 is a sectional side view of the conventional converter.
Figure 11:
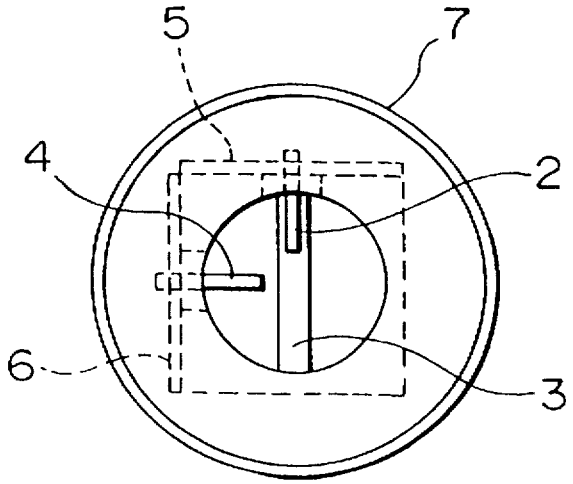
FIG. 11 PRIOR ART
FIG. 11 is a front view of the conventional converter.

The process of attaching the generally L-shaped first probe 13 to the waveguide 10 will be described. As shown in FIG. 7, a bent portion 13*a* of the first probe 13 is positioned at the groove 26 open in the rear opening end 10*a* of the waveguide 10 and is directly inserted into the groove 26. During this insertion, a portion of the first probe 13 on the extreme end side of the bent portion 13*a* is guided by the slit portion 26*a* while the insulating member 14 covering the probe 13 is guided by the expanded portion 26*b*, thereby enabling the first probe 13 to be easily set in the predetermined position. Of the first probe 13 attached to the waveguide 10 in this manner, the straight portion inserted in the groove 26 forms a coaxial line to lead a received signal to the circuit substrate 11. The thickness of the probe 13, the thickness and dielectric constant of the insulating member 14, and inside diameter of the expanded portion 26*b* and so on may be selected to accurately set a predetermined impedance. Also, the length of the portion of the first probe 13 projecting inside the waveguide 10 can be accurately set by virtue of the configuration of the groove 26. The operation of connecting the base end portion of the first probe 13 to the circuit substrate 11 may be performed before or after the attachment of the probe 13 to the waveguide 10.

In the above-described embodiment, the circuit substrate 11 has a portion extended at a position about ¼ wavelength apart from the first probe 13 in the electric wave travel direction and the shorting pattern 15 and the second probe 16 are respectively formed on the obverse and reverse surfaces of this extended portion of the circuit substrate 11, as shown in FIG. 1. Therefore, the distance between the first probe 13 and the shorting surface 12*b* can be reduced relative to that in the conventional converter, that is, it is about ½ of the wavelength of electric waves to be received if the distance between the first probe 13 and the shorting pattern 15 and the distance between the second probe 16 and the shorting surface 12*b* are set to about ¼ of the wavelength of the received electric waves to limit the conversion loss. Thus, an outdoor converter which is advantageously small in size can be obtained. Moreover, if the distance between the first probe 13 and the shorting surface 12*b* is set to about ½ of the wavelength, interference between polarized wave signals detected with the probes 13 and 16, which can cause deterioration in isolation, can be prevented.

Also, in the above-described embodiment, the extreme-end portion of the generally L-shaped first probe 13 projecting in the waveguide 10 and the circuit substrate 11 to which the base end portion of the probe 13 is connected are in parallel with each other. Therefore, the shorting pattern 15 for the first probe 13 and the second probe 16 can be provided on the obverse and reverse surfaces of the circuit substrate 11 and they can be regarded as parts of the circuit substrate 11. Accordingly, only one circuit substrate suffices according to the present invention while two circuit substrates are required for the two probes in the conventional arrangement. Also, the need for a shorting rod and a probe which must be prepared and used as separate parts can be eliminated. As a result, the number of component parts can be markedly reduced and the manufacturing cost can easily be reduced effectively. Further, in this embodiment, the grounding electrodes 17 formed of solder plating layers are pressed so as to be suitably depressed when the screws 18 are fastened at the time of attachment of the metallic case 12. The grounding electrodes 17, the waveguide 10 and the metallic case 12 (shorting surface 12*b*) can be connected reliably in this manner, so that the converter can have stable characteristics.

In the outdoor satellite broadcast receiving converter of the present invention, as described above, both the shorting terminal for the first probe for detecting the first linearly polarized wave and the second probe for detecting the second linearly polarized wave orthogonal to the first linearly polarized wave are positioned about ¼ wavelength apart from the first probe in the electric wave travel direction, so that the distance between the first probe and the shorting terminal for the second probe can be set to about ½ of the wavelength of electric waves to be received. As a result, improved isolation can be achieved and the overall size of the converter can be reduced.

Also, the construction in which the generally L-shaped probe to be connected to the circuit substrate in an insulated state in the groove formed in the inner wall of the waveguide enables the two probes adapted to detect two kinds of linearly polarized waves to be connected to the common circuit substrate and also enables the shorting terminal for the generally L-shaped probe to be mounted on the same circuit substrate while supporting the circuit substrate without increasing the overall size of the apparatus.

If the shorting terminal for the first probe and the second probe are formed on obverse and reverse surfaces of one substrate by utilizing an extended portion of the circuit substrate or in a different fashion, the number of component parts can be reduced, so that the apparatus can easily be reduced in manufacturing cost, size and weight.

What is claimed is:

1. An outdoor satellite broadcast receiving converter, comprising:

a waveguide which a broadcast electric wave enters and in which the broadcast electric wave travels as a first linearly polarized wave and a second linearly polarized wave orthogonal to each other;

a first probe for detecting the first linearly polarized wave, said first probe being disposed at a predetermined position in said waveguide;

a first shorting terminal for reflecting the first linearly polarized wave, said first shorting terminal being disposed about ¼ wavelength apart from said first probe in the electric wave travel direction;

a second probe for detecting the second linearly polarized wave, said second probe being disposed in the waveguide adjacent to said first shorting terminal; and a second shorting terminal for reflecting the second linearly polarized wave, said second shorting terminal being disposed about ¼ wavelength apart from said second probe in the electric wave travel direction;

wherein a substrate is disposed at a position about ¼ wavelength apart from said first probe in the electric wave travel direction, said first shorting terminal being disposed on one of obverse and reverse surfaces of said substrate facing said first probe, said second probe being disposed on the other surface of said substrate.

2. A converter according to claim 1, wherein said substrate is placed at an opening end of said waveguide, and a metallic case having a closed bottom is placed at a position such as to close said opening end with said substrate interposed therebetween, an inner bottom surface of said metallic case being provided as said second shorting terminal.

3. A converter according to claim 2, wherein grounding electrodes are provided on portions of the obverse and reverse surfaces of said substrate corresponding to a peripheral portion of said opening end and are connected to each other via at least one through hole formed in said substrate, said waveguide and said metallic case being in contact with the grounding electrodes.

4. A converter according to claim 3, wherein a multiplicity of said through holes are formed along the peripheral portion of said opening end.

5. A converter according to claim 4, wherein said grounding electrodes are formed of solder plating layers.

6. A converter according to claim 3, wherein said grounding electrodes are formed of solder plating layers.

7. A converter according to claim 1, wherein a circuit substrate on which circuits for processing signals detected with said first and second probes are provided has a portion extended in said waveguide, said extended portion being provided as said substrate.

8. A converter according to claim 7, wherein said substrate is placed at an opening end of said waveguide, and a metallic case having a closed bottom is placed at a position such as to close said opening end with said substrate interposed therebetween, an inner bottom surface of said metallic case being provided as said second shorting terminal.

9. A converter according to claim 8, wherein grounding electrodes are provided on portions of the obverse and reverse surfaces of said substrate corresponding to a peripheral portion of said opening end and are connected to each other via at least one through hole formed in said substrate, said waveguide and said metallic case being in contact with the grounding electrodes.

10. A converter according to claim 9, wherein a multiplicity of said through holes are formed along the peripheral portion of said opening end.

11. A converter according to claim 10, wherein said grounding electrodes are formed of solder plating layers.

12. A converter according to claim 9, wherein said grounding electrodes are formed of solder plating layers.

13. An outdoor satellite broadcast receiving converter comprising:

a waveguide which a broadcast electric wave enters and in which the broadcast electric wave travels as two kinds of linearly polarized waves orthogonal to each other;

a circuit substrate disposed at an opening end of said waveguide perpendicularly to an axial direction of said waveguide; and a probe for detecting one of the two kinds of linearly polarized waves traveling in said waveguide, said probe having a base end portion connected to said circuit substrate, said probe extending from its base end portion so as to be generally L-shaped, wherein a groove is formed in an inner wall portion of said waveguide so as to extend in the axial direction of said waveguide and to be open at said opening end, a portion of said probe extending straight from the base end portion being set in an insulated state in said groove, a portion of said probe on the extreme end side of said straight-extending portion projecting in said waveguide.

14. A converter according to claim 13, wherein said groove of said waveguide has a slit portion small in width and open in an inner wall surface of said waveguide and a large-width portion larger in width than said slit portion and communicating with the interior of said waveguide through said slit portion.

15. A converter according to claim 14, wherein said large-width portion has a circular sectional shape.

16. A converter according to claim 15, wherein the portion of said probe set in said groove is covered with an insulating member.

17. A converter according to claim 16, wherein a shorting terminal for reflecting the linearly polarized light to be detected with said probe is provided in a region in a surface of said circuit substrate facing an extreme end portion of said probe projecting in said waveguide.

18. A converter according to claim 17, wherein the distance between the extreme end portion of said probe and said shorting terminal is set to about ¼ of the wavelength of an electric wave to be received.

19. A converter according to claim 15, wherein a shorting terminal for reflecting the linearly polarized light to be detected with said probe is provided in a region in a surface of said circuit substrate facing an extreme end portion of said probe projecting in said waveguide.

20. A converter according to claim 19, wherein the distance between the extreme end portion of said probe and said shorting terminal is set to about ¼ of the wavelength of an electric wave to be received.

21. A converter according to claim 14, wherein the portion of said probe set in said groove is covered with an insulating member.

22. A converter according to claim 21, wherein a shorting terminal for reflecting the linearly polarized light to be detected with said probe is provided in a region in a surface of said circuit substrate facing an extreme end portion of said probe projecting in said waveguide.

23. A converter according to claim 22, wherein the distance between the extreme end portion of said probe and said shorting terminal is set to about ¼ of the wavelength of an electric wave to be received.

24. A converter according to claim 14, wherein a shorting terminal for reflecting the linearly polarized light to be detected with said probe is provided in a region in a surface of said circuit substrate facing an extreme end portion of said probe projecting in said waveguide.

25. A converter according to claim 24, wherein the distance between the extreme end portion of said probe and said shorting terminal is set to about ¼ of the wavelength of an electric wave to be received.

26. A converter according to claim 13, wherein the portion of said probe set in said groove is covered with an insulating member.

27. A converter according to claim 26, wherein a shorting terminal for reflecting the linearly polarized light to be detected with said probe is provided in a region in a surface of said circuit substrate facing an extreme end portion of said probe projecting in said waveguide.

28. A converter according to claim 27, wherein the distance between the extreme end portion of said probe and said shorting terminal is set to about ¼ of the wavelength of an electric wave to be received.

29. A converter according to claim 13, wherein a shorting terminal for reflecting the linearly polarized light to be detected with said probe is provided in a region in a surface of said circuit substrate facing an extreme end portion of said probe projecting in said waveguide.

30. A converter according to claim 29, wherein the distance between the extreme end portion of said probe and said shorting terminal is set to about ¼ of the wavelength of an electric wave to be received.

31. An outdoor satellite broadcast receiving converter comprising:

a waveguide which a broadcast electric wave enters and in which the broadcast electric wave travels as two kinds of linearly polarized waves orthogonal to each other;

a circuit substrate disposed at an opening end of said waveguide perpendicularly to an axial direction of said waveguide, said circuit substrate having a portion extended in said waveguide; and a probe for detecting one of the two kinds of linearly polarized waves traveling in said waveguide, said probe extending from the extended portion of said circuit substrate so as to be generally L-shaped, wherein a groove is formed in an inner wall portion of said waveguide so as to extend in the axial direction of said waveguide and to be open at said opening end, a portion of said probe extending straight from the extended portion of said circuit substrate being set in an insulated state in said groove, a portion of said probe on the extreme end side of said straight-extending portion projecting in said waveguide.

32. A converter according to claim 31, wherein said groove of said waveguide has a slit portion small in width and a large-width portion larger in width than said slit portion and communicating with the interior of said waveguide through said slit portion.

33. A converter according to claim 32, wherein said large-width portion has a circular sectional shape.

34. An outdoor satellite broadcast receiving converter comprising:

a waveguide which a broadcast electric wave enters and in which the broadcast electric wave travels as two kinds of linearly polarized waves orthogonal to each other;

a circuit substrate disposed between said waveguide and a metallic case having a closed bottom; and a probe for detecting one of the two kinds of linearly polarized waves traveling in said waveguide, said probe having a base end portion connected to said circuit substrate, said probe extending from its base end portion so as to be generally L-shaped, wherein a groove is formed in an inner wall portion of said waveguide so as to extend in the axial direction of said waveguide and to be open at said opening end, a portion of said probe extending straight from the base end portion being set in an insulated state in said groove, a portion of said probe on the extreme end side of said straight-extending portion projecting in said waveguide.

* * * * *